US007269366B2

(12) United States Patent
Lee et al.

(10) Patent No.: US 7,269,366 B2
(45) Date of Patent: Sep. 11, 2007

(54) METHOD AND APPARATUS FOR CONTROLLING A FIXER OF A PRINTER

(75) Inventors: Beom-Ro Lee, Suwon-si (KR); Jun-Bae Jeon, Yongin-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 107 days.

(21) Appl. No.: 11/133,454

(22) Filed: May 20, 2005

(65) Prior Publication Data

US 2006/0013602 A1 Jan. 19, 2006

(30) Foreign Application Priority Data

Jul. 19, 2004 (KR) ..... 10-2004-0055892

(51) Int. Cl.
*G03G 15/00* (2006.01)
*G03G 15/20* (2006.01)

(52) U.S. Cl. ..... 399/45; 399/67; 399/68

(58) Field of Classification Search ..... 399/45, 399/68, 67, 69, 320, 16, 66, 389
See application file for complete search history.

(56) References Cited

U.S. PATENT DOCUMENTS

| | | | | |
|---|---|---|---|---|
| 5,438,399 | A * | 8/1995 | Asai | 399/314 |
| 6,477,339 | B1 * | 11/2002 | Yano et al. | 399/66 |
| 6,804,478 | B2 * | 10/2004 | Martin et al. | 399/45 |
| 2002/0168193 | A1 * | 11/2002 | Weaver | 399/45 |

FOREIGN PATENT DOCUMENTS

| | | | |
|---|---|---|---|
| JP | 58-062680 | | 4/1983 |
| JP | 08-022199 | | 1/1996 |
| JP | 08-179636 | A * | 7/1996 |
| JP | 08-190303 | | 7/1996 |
| JP | 10-020575 | | 1/1998 |
| JP | 10-063049 | | 3/1998 |
| JP | 11-258920 | | 9/1999 |
| JP | 2000-098771 | | 4/2000 |
| JP | 2000-131971 | | 5/2000 |
| JP | 2001-209254 | | 8/2001 |
| KR | 2000-0040694 | | 7/2000 |
| KR | 2002-46945 | | 6/2002 |

OTHER PUBLICATIONS

Korean Official Action, dated Feb. 10, 2006.

* cited by examiner

*Primary Examiner*—Sophia S. Chen
(74) *Attorney, Agent, or Firm*—Roylance, Abrams, Berdo & Goodman, L.L.P.

(57) ABSTRACT

A method and apparatus are provided for controlling a fixing condition of a printer according to the size and type of paper to be printed in order to improve print quality. The apparatus and method include setting a fixing condition according to a selected paper property of a printer driver, measuring a resistance of a paper being printed, comparing a paper property corresponding to the measured paper resistance with the selected paper property of the printer driver, and resetting the fixing condition according to the paper property corresponding to the measured paper resistance if the paper property corresponding to the measured paper resistance is different from the selected paper condition of the printer driver.

13 Claims, 6 Drawing Sheets

| PAPER TYPE | FIXING CONDITION | |
|---|---|---|
| | TEMPERATURE | SPEED |
| ORDINARY PAPER | T | V |
| THICK PAPER | $T+\Delta T_1$ | $V+\Delta V_1$ |
| OHP | $T+\Delta T_2$ | $V+\Delta V_2$ |
| ENVELOP | $T+\Delta T_3$ | $V+\Delta V_3$ |
| RECYCLES PAPER | $T+\Delta T_4$ | $V+\Delta V_4$ |

| PAPER TYPE | RESISTANCE | FIXING CONDITION | |
|---|---|---|---|
| | | TEMPERATURE | SPEED |
| ORDINARY PAPER | R | T | V |
| THICK PAPER | $R+\Delta R_1$ | $T+\Delta T_1$ | $V+\Delta V_1$ |
| OHP | $R+\Delta R_2$ | $T+\Delta T_2$ | $V+\Delta V_2$ |
| ENVELOP | $R+\Delta R_3$ | $T+\Delta T_3$ | $V+\Delta V_3$ |
| RECYCLES PAPER | $R+\Delta R_4$ | $T+\Delta T_4$ | $V+\Delta V_4$ |

METHOD AND APPARATUS FOR CONTROLLING A FIXER OF A PRINTER

PRIORITY

This application claims the benefit under 35 U.S.C. 119(a) of Korean Patent Application No. 2004-55892, filed on Jul. 19, 2004, in the Korean Intellectual Property Office, the entire disclosure of which is incorporated herein by reference.

BACKGROUND OF THE INVENTION

1. Field of the Invention

The present invention relates to a printer having a fixer that adheres a transferred toner image to paper. More particularly, the present invention relates to a method and apparatus for controlling a fixing condition of a printer according to the size and type of paper used in order to improve the print quality.

2. Description of the Related Art

Printers are the most common output devices for printing the results of data processed onto paper in order to check, store, and deliver data from a computer, camera, facsimile and the like. Printers comprise the basic element of multi-functional printers, facsimiles, electronic cash registers, automatic teller machines, and so on.

Various types of printers have been developed such as daisy wheel, dot pin, ink jet, laser printers and especially the ink jet and laser printers, which are widely adopted.

The laser printer uses physical elements such as toner, light (laser or light emitting diode (LED) array), static electricity, heat, and pressure to perform a printing operation. The core technology of the laser printer uses static electricity.

FIG. 1 is a schematic view illustrating a conventional laser printer.

Referring to FIG. 1, a laser printer includes a print unit 100 for printing an image onto paper, a sheet output passage 310, a sheet turn passage 320, a pick-up roller 201, and a feed roller 210.

The print unit 100 includes a charger 120, a Laser Scan Unit (LSU) 130, a photoconductive drum 110, a development unit 140 holding a developer, a transfer belt 150, and a fixer 170. The print unit 100 prints an image on paper, using an electrophotographic method. The development unit 140 of the print unit 100 includes four cartridges respectively holding black (K), cyan (C), magenta (M), and yellow (Y) developers, in order to print a color image.

Operations of forming an image by the print unit 100 are as followings. In a charge operation mode, the charger 120 charges the photoconductive drum 110 uniformly. In an exposure operation mode, the LSU 130 supplies the photoconductive drum 110 with a light corresponding to a color of image data such as a yellow color. The light causes a voltage difference between light exposed and non-exposed surfaces of the photoconductive drum 110, thereby creating an electrostatic latent image of yellow. In a development operation mode, the development unit 140 applies the developer to the electrostatic latent image in order to form a yellow toner image. The developed yellow toner image is transferred to the transfer belt 150.

After the yellow toner image is completely transferred to the transfer belt 150, magenta M, cyan C, and black K toner images are sequentially transferred and overlapped onto the transfer belt 150 with the same method as is mentioned above in order to make a color toner image on the transfer belt 150. The color toner image is transferred onto paper that passes between the transfer belt 150 and a transfer roller 160, and the fixer 170 applies heat and pressure to the color toner image to adhere the image onto the paper, thereby completing a color image print. Herein, the fixer 170 includes a heat roller 171 and a pressure roller 172.

Though the exemplary print unit 100 shown in FIG. 1 is a multi-path type printer that uses one photoconductive drum and one LSU, there are various types of electrophotographic print units that can employ aspects of the present invention.

The sheet output passage 310 connects an outlet of the print unit 100 and a sheet output tray 230. Typically, the fixer 170 is placed at the outlet side of the print unit 100. A pair of rollers 220 is used to eject the paper that has been printed.

When printing an image onto each side of paper, an image is printed on one side of the paper and the paper turns over and returns to the print unit 100 through the sheet turn passage 320. The sheet turn passage 320 is separated from the sheet output passage 310 and extended to the feed roller 210.

FIG. 2 is a block diagram illustrating a conventional circuit construction of a printer.

Referring to FIG. 2, the printer 200 includes an interface 202, a controller 204, a memory 206, a lookup table 208, an input/output (I/O) interface 210, an operator panel 212, and a print engine 214.

The operator panel 212 includes a plurality of keys for receiving various commands from the user and a display for presenting operational information to the user.

Through the interface 202, command signals, print data, and the like are received from the host computer (not shown) and signals such as printing status signals are sent to the host computer. The received print data from the host computer is buffered in the memory 206.

The controller 204 communicates with the host computer through the interface 202 and controls the print engine 214 to print the print data according to commands from the host computer and the operator panel 212. The controller 204 can also access lookup tables from lookup table 208.

The memory 206 stores setup values from the operator panel 212 and print data from the host computer under the control of the controller 204. Also, the memory 206 may store an operating program of the controller 204.

The I/O interface 210 connects the controller 204, the operator panel 212, and the print engine 214, for exchanging data such as input/out signals of the controller 204. The print data is transmitted to the print engine 214 through the I/O interface 210.

The print engine 214 includes many devices for feeding paper and printing on the paper, and performs the printing operation under the control of the controller 204.

Since the laser printer uses heat to affix the toner onto the paper, operational properties of the fixer 170 must be properly adjusted according to the size and type of the paper to be printed. For example, the fixing temperature and fixing speed must be properly set according to the size and type of the paper in order to affix the toner onto the paper thoroughly.

For this, the size and type of the paper are selected through a printer driver of the host computer in the related art.

FIG. 3 is a table illustrating the relationship between paper properties and fixing conditions of a printer shown in FIG. 2. T and V denote a reference temperature and a reference speed for fixing, respectively. $\Delta T1$-$\Delta T4$ and $\Delta V1$-$\Delta V4$ differ with respect to the type of paper used. T, V, $\Delta T$ and ΔV vary depending on the manufacturer and the model used. However, in general, the fixing temperature and fixing speed for thick paper and OHP are inferior to those for other types and sizes of paper.

The lookup table 208 stores a table shown in FIG. 3 and the controller 204 uses the values in the table 208. The controller 204 controls the fixing operation of the print engine 214 with the paper information of the printer driver and the fixing conditions of the lookup table 208.

FIG. 4 is a flow chart illustrating a method of controlling a conventional fixer.

Referring to FIG. 4, when a printing operation starts, the size and type of the paper are selected using the printer driver in step S402.

In step S404, the controller 204 sets the fixing speed and temperature of the print engine 214 according to the size and type of the paper selected from the printer driver.

In step S406, the development unit 140 of the print engine 214 forms a toner image on the photoconductive drum 110 and the transfer belt 150.

In step S408, the image transferred onto the transfer belt 150 is transferred to the paper.

In step S410, the fixer 170 of the print engine 214 performs a fixing operation according to the fixing speed and temperature set in step S404.

After above operations, the paper is output and the printing operation ends.

As described above, in the related art method of controlling the fixer of the printer, the fixing conditions (temperature and speed) is set before starting a printing operation according to the paper conditions (size and type) selected using the printer driver, and the printer performs the fixing operation according to the fixing conditions. However, if the paper conditions selected using the printer driver is not correct, the fixing operation is performed improperly.

The drawback of the related art method is that there is no way of correcting the paper conditions during printing operation when the selected paper conditions and actual paper conditions are different.

Accordingly, there is a need for setting fixing parameters based on actual paper size rather than a predetermined paper size.

SUMMARY OF THE INVENTION

The present invention has been developed in order to solve at least the above described drawbacks and other problems associated with the conventional arrangement and to provide at least the advantages described below.

The present invention provides a method of controlling a fixer of a printer, in which a fixing condition is reset according to a measured type of paper being printed, thereby preventing an improper fixing.

Also, the present invention provides an apparatus suitable for controlling a fixer of a printer.

According to an aspect of the present invention, a method of controlling a fixer of a printer comprises setting a fixing condition according to a selected paper property of a printer driver; measuring a resistance of a paper being printed; comparing a paper property corresponding to the measured paper resistance with the selected paper property of the printer driver; and resetting the fixing condition according to the paper property corresponding to the measured paper resistance when the paper property corresponding to the measured paper resistance is different from the selected paper condition of the printer driver.

According to another aspect of the present invention, a printer comprises a print engine having a fixer capable of operating according to a set fixing condition; a paper resistance meter for measuring a paper resistance; a lookup table for storing the fixing condition corresponding to a paper property; and a controller for setting the fixing condition of the print engine by choosing the fixing condition from the lookup table according to the measured paper resistance.

The fixing condition may be a fixing speed of the fixer.

BRIEF DESCRIPTION OF THE DRAWINGS

The above and other features and advantages of the present invention will become more apparent by describing in detail exemplary embodiments thereof with reference to the attached drawings in which.

Throughout the drawings, it should be noted that like reference numbers are used to depict the same or similar elements, features and structures.

DETAILED DESCRIPTION OF AN EXEMPLARY EMBODIMENT

An exemplary embodiment of the present invention will now be described more fully with reference to the accompanying drawings.

Embodiments of the present invention are characterized in that paper properties, for example, the size and type of paper are measured during a printing operation and fixing conditions (temperature and speed) of a fixer are set according to measured paper properties.

The measured paper properties may be compared with paper properties selected from a printer driver and, if the two properties are different, the fixing condition is reset according to the measured paper properties.

Figure 5:
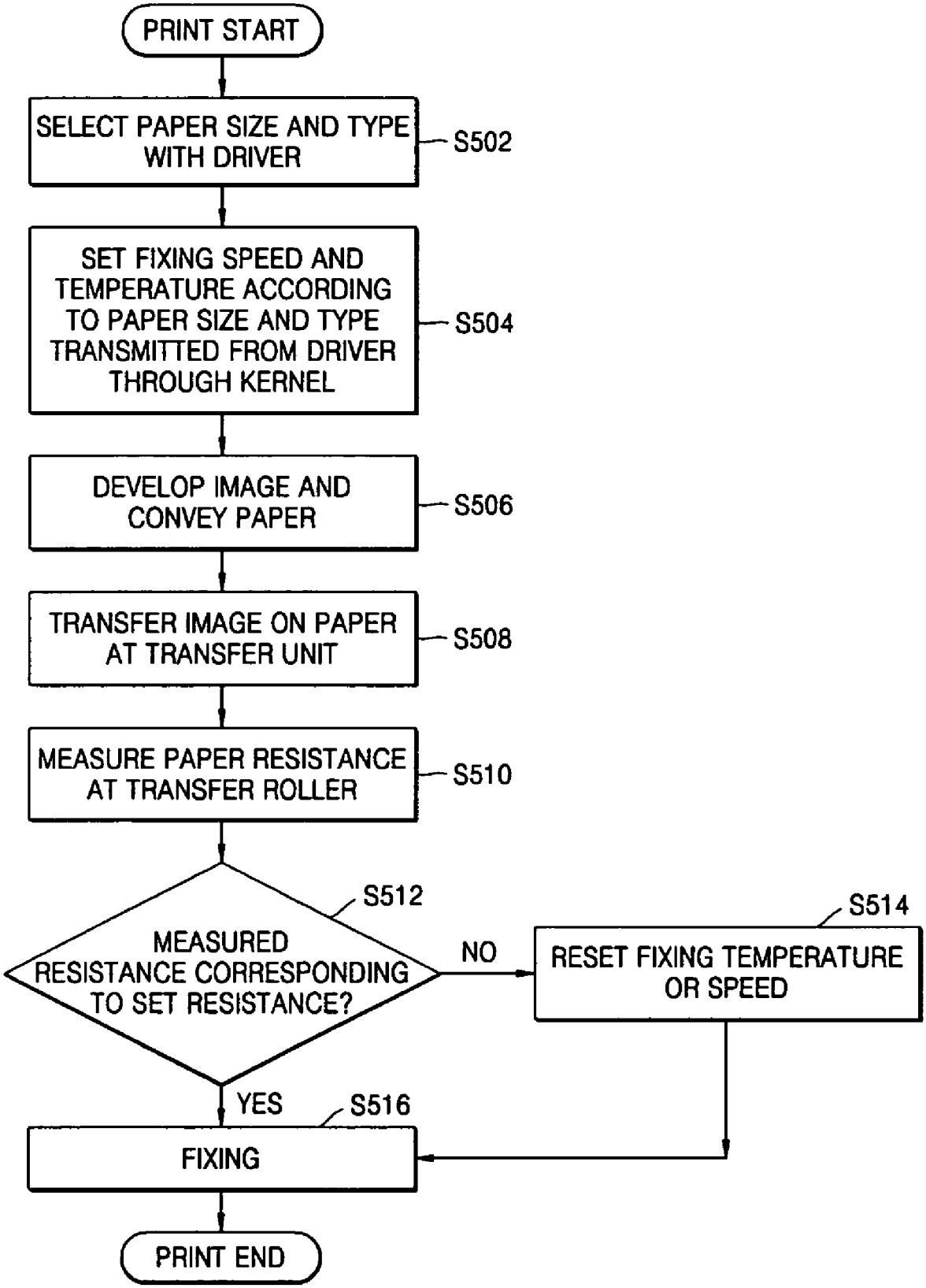
FIG. 5 is a flow chart illustrating a method of controlling a fixer according to an embodiment of the present invention.

FIG. 5 is a flow chart illustrating a method of controlling a fixer according to an embodiment of the present invention.

Referring to FIG. 5, when a printing operation starts, the paper properties, the size and type of the paper, are selected using the printer driver in step S502.

In step S504, a print engine sets the fixing conditions, the speed and temperature of a fixer, according to the paper properties that are selected from the printer driver and received through a printer kernel.

In step S506, a development unit forms an image on a photoconductive drum and a transfer belt.

In step S508, a transfer unit transfers the image formed on the transfer belt to the paper. The method proceeds to step S510, where a resistance of the paper is measured.

In step S512, the measured paper resistance is compared to the paper properties selected from the printer driver.

In step S514, if the measured paper resistance does not correspond to the paper properties selected from the printer driver, the fixing conditions are reset according to the measured paper resistance.

In step S516, the fixer performs a fixing operation according to the set or reset fixing conditions. The fixing operation is output and the printing operation ends.

The fixing conditions set in step S514 may be the temperature and speed of the fixing operation. In order to control the temperature, heat produced from a heat roller (see 171 in FIG. 6) is to be controlled, but the response time of the temperature control cannot handle the print speed. Contrarily, the response time of a speed control of the fixing operation is faster than that of the temperature control. Therefore, controlling the speed is more preferable to controlling the temperature.

Figure 6:
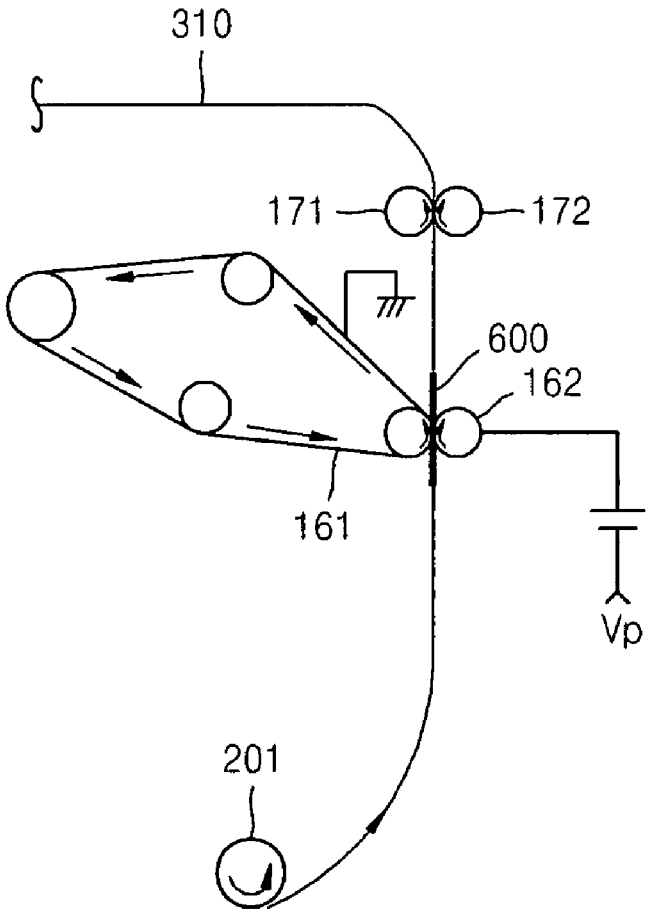
FIG. 6 is a schematic view illustrating a method of measuring a resistance of paper at a transfer unit according to an embodiment of the present invention.

FIG. 6 is a schematic view illustrating a method of measuring a resistance of paper at a transfer unit according to an embodiment of the present invention.

Referring to FIG. 6, since a piece of paper 600 passes between a transfer belt 161 and a transfer roller 162, a voltage difference between the transfer belt 161 and the transfer roller 162 is proportional to the resistance of the paper 600 passing therebetween.

Figure 7:
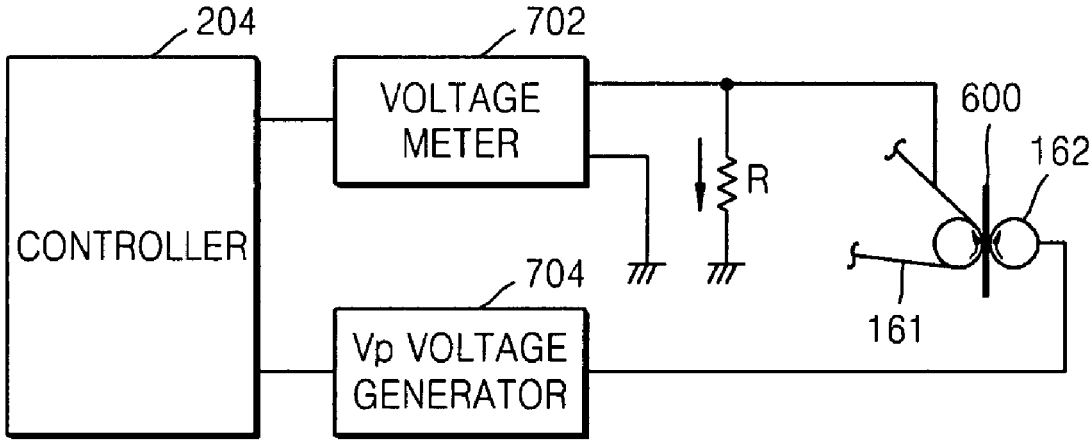
FIG. 7 is a block diagram illustrating a construction of a paper resistance meter according to an embodiment of the present invention.

FIG. 7 is a block diagram illustrating a construction of a paper resistance meter according to an embodiment of the present invention.

Referring to FIG. 7, a Vp-voltage generator 704 applies a voltage of Vp to the transfer roller 162, and a resistor (R) is connected between the transfer belt 161 and ground in order to measure a voltage. A voltage across the resistor R changes according to the type of paper passing between the transfer belt 161 and the transfer roller 162. A voltage meter 702 measures the voltage across the resistor R, and the measured voltage is sent to a controller 204.

The controller 204 calculates the paper resistance from the voltage measured by the voltage meter 702 and evaluates whether the calculated paper resistance corresponds to the paper properties selected from the printer driver. If the calculated resistance does not correspond to the selected paper properties, the controller 204 determines what size and type of paper corresponds to the calculated resistance and resets the temperature and speed of the fixer according to the determined size and type of paper.

Figures 8, 9:
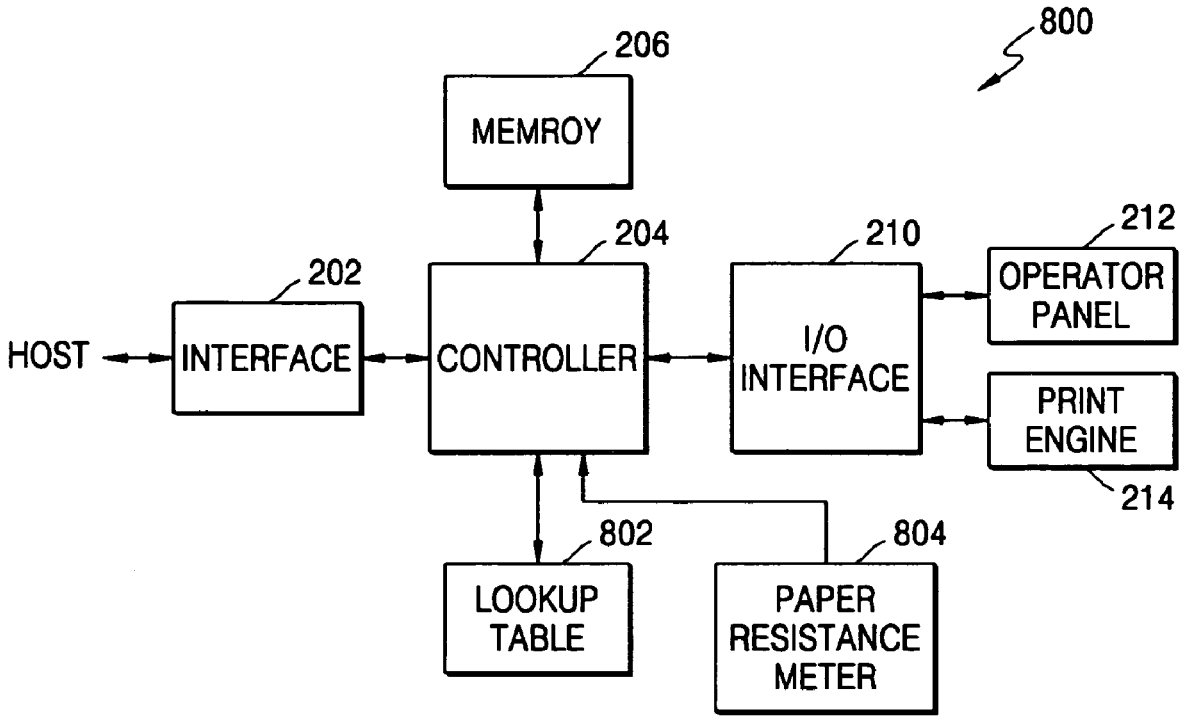
FIG. 8 is a block diagram illustrating a construction of a printer according to an embodiment of the present invention.
FIG. 9 is a view illustrating contents to be stored in a lookup table depicted in FIG. 8.

FIG. 8 is a block diagram illustrating a construction of a printer according to an embodiment of the present invention.

Figure 1:
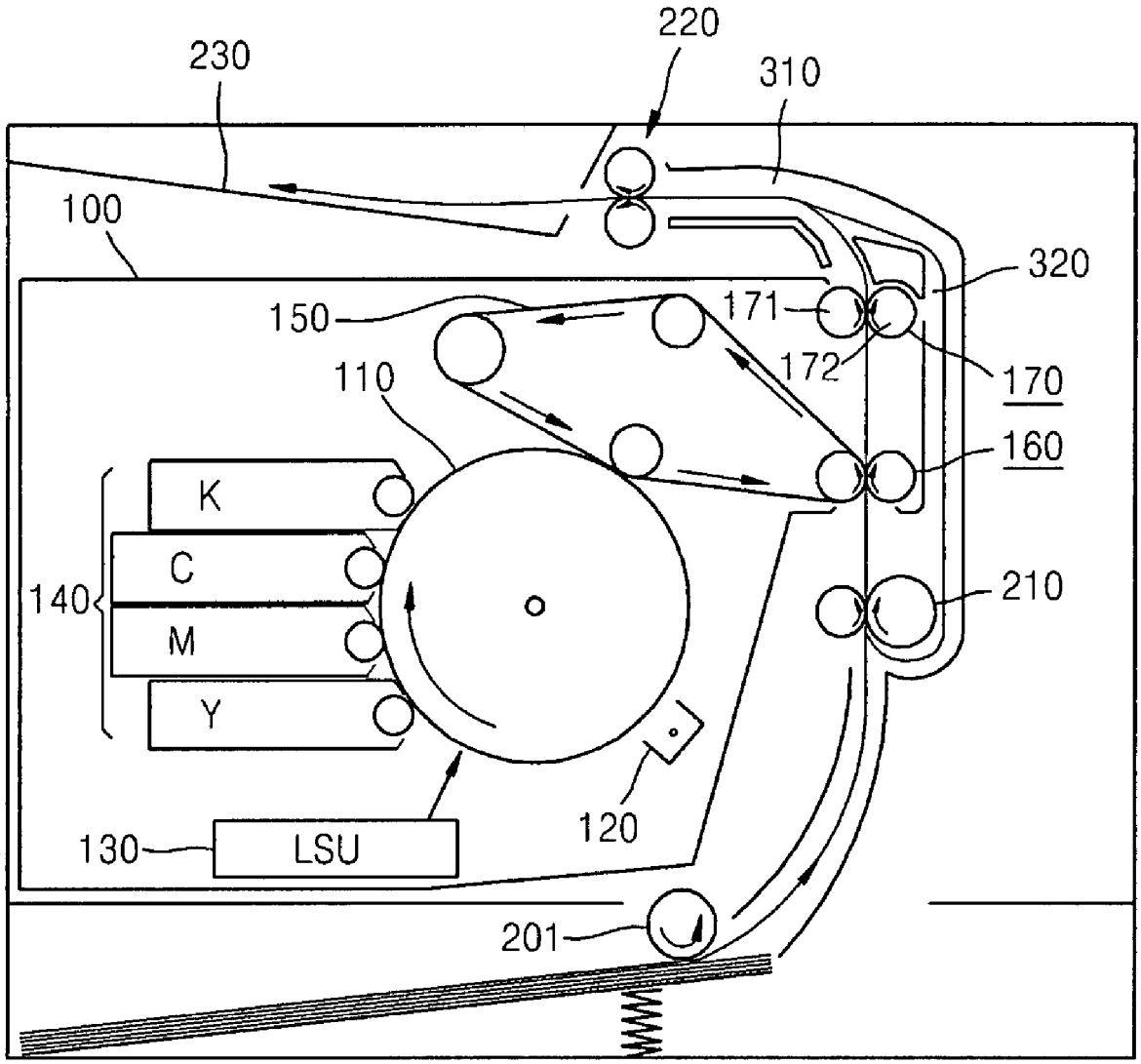
FIG. 1 (PRIOR ART)
FIG. 1 is a schematic view illustrating a mechanical construction of a conventional laser printer.
Figures 2, 3:
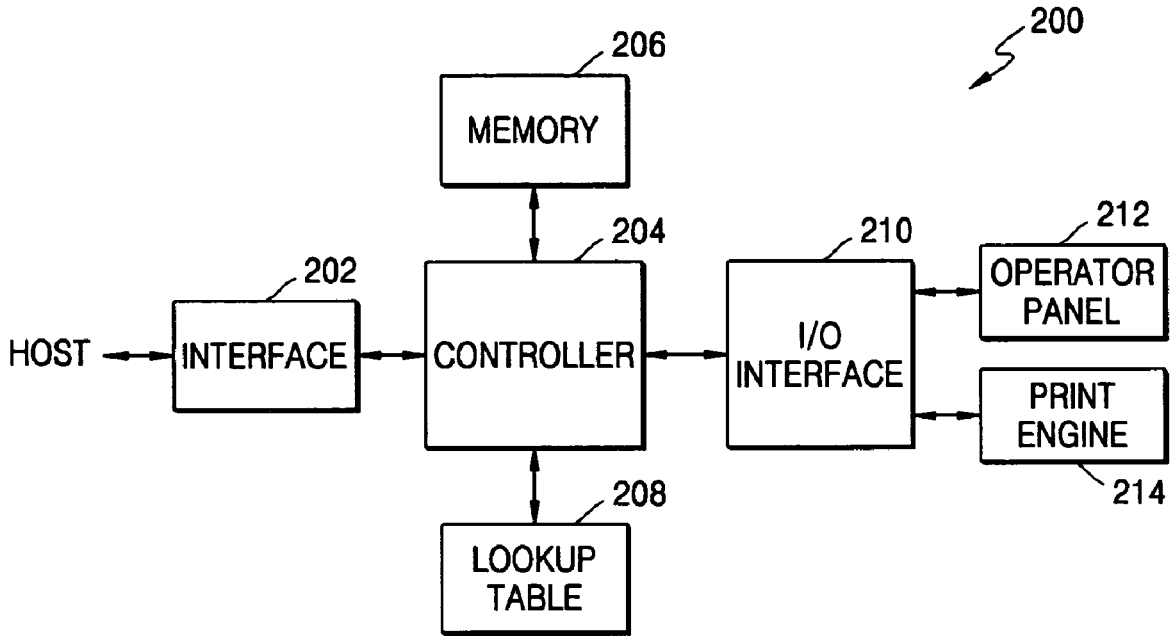
FIG. 2 (PRIOR ART)
FIG. 3 (PRIOR ART)
FIG. 2 is a block diagram illustrating a circuit construction of a conventional printer according to the related art.
FIG. 3 is a table illustrating the relationship between paper properties and fixing conditions of the printer shown in FIG. 2.
Figure 4:
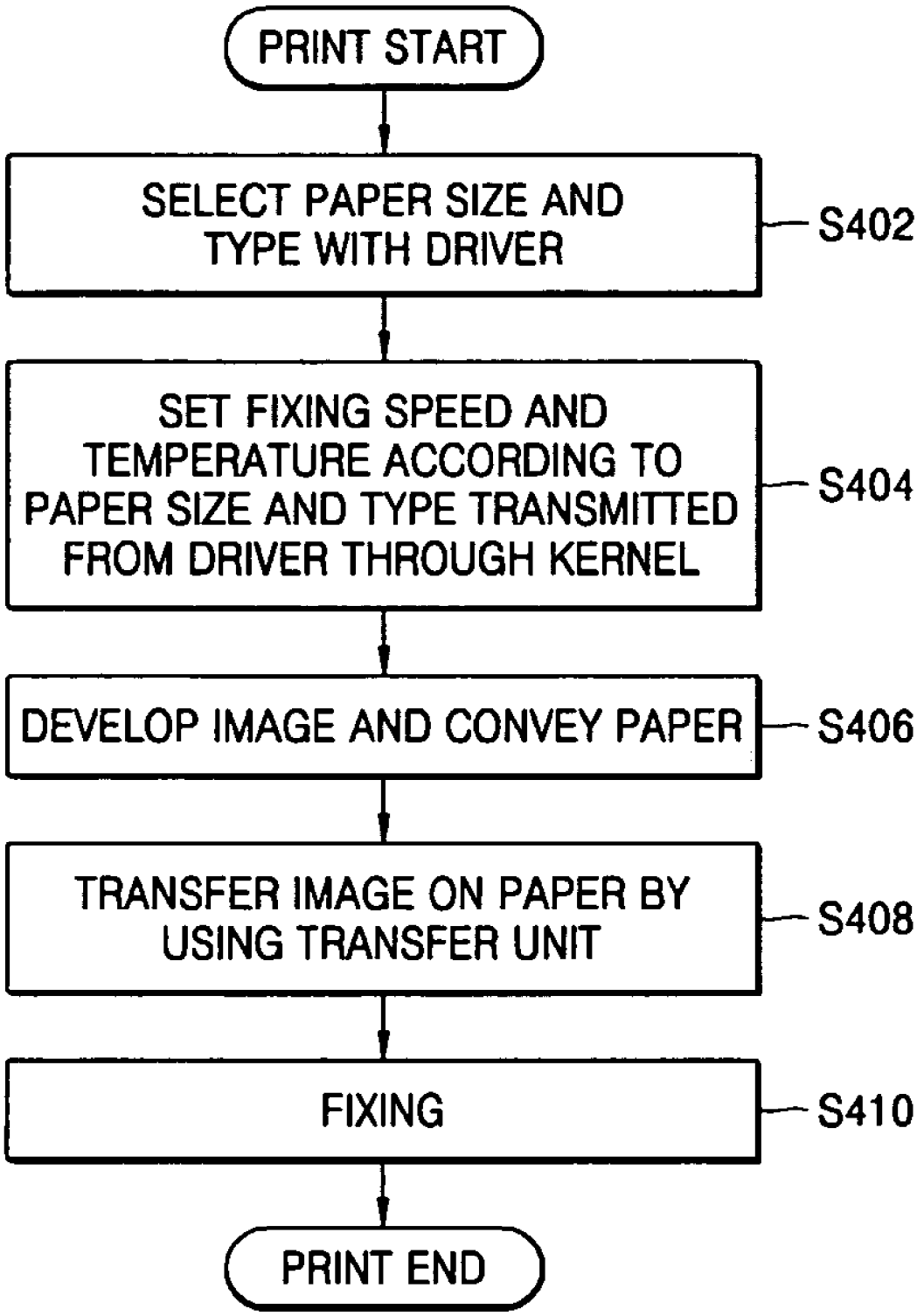
FIG. 4 (PRIOR ART)
FIG. 4 is a flow chart illustrating a conventional method of controlling a fixer.

Referring to FIG. 8, devices similar to those shown in FIG. 2 are denoted by the same reference numerals and descriptions thereof will be omitted. A printer 800 further includes a lookup table 802 and a paper resistance meter 804, compared with a printer shown in FIG. 2.

FIG. 9 is a view illustrating contents to be stored in a lookup table depicted in FIG. 8. T and V denote a reference temperature and a reference speed for fixing, respectively. R denotes a reference resistance. ΔR1-ΔR4, ΔT1-ΔT4 and ΔV1-ΔV4 differ with respect to the type of paper used. T, V, R, ΔR, ΔT and ΔV vary depending on the manufacturer and the model used. However, in general, the fixing temperature and fixing speed for thick paper and OHP are inferior to those for other types and sizes of paper.

Referring to FIG. 9, the resistances and fixing conditions, corresponding to the paper properties, are stored in the lookup table 802. Various types of standard paper, thick paper, transparencies, envelopes, and so on can be printed. Standard paper has a mass per area property of 75-95 g/m$^2$, and thick paper is harder and heavier than standard paper. Standard paper has less resistance than thick paper. Recycled paper can also be printed and recycled paper has a resistance value between that of standard paper and thick paper. In other words, the lookup table 802 stores the resistances of various types of paper and the corresponding fixing conditions.

Referring again to FIG. 8, the paper resistance meter 804 measures the resistance of the paper during the printing operation. Since the resistance of the paper can vary due to the amount of toner transferred onto the paper, a mean resistance calculated from measured resistances along the paper may be used.

When a printing operation starts, the controller 204 receives a print command through an interface 202, and refers to the paper properties selected from the printer driver and values stored in the lookup table 802 in order to set the fixing conditions.

During the print operation, the controller 204 controls the paper resistance meter 804 to measure the resistance of the paper being printed and searches for a paper type, corresponding to the measured resistance, in the lookup table 802. Then, the controller 204 compares the paper type determined in the lookup table 802 with the paper type selected from the printer driver.

If the two types of paper are different, the controller 204 resets the fixing conditions according to the searched paper types, which correspond to the measured paper resistance.

As described above, in the method of controlling a fixer of a printer according to an embodiment of the present invention, the resistance of the paper being printed is measured and the fixing conditions are reset according to the paper type corresponding to the measured paper resistance, such that an improper fixing can be prevented.

While this invention has been particularly shown and described with reference to a certain embodiment thereof, it should be understood by those skilled in the art that various changes in form and details may be made therein without departing from the spirit and scope of the invention as defined by the appended claims.

What is claimed is:

1. A method of controlling a fixer of a printer, comprising:

setting a fixing condition according to a selected paper property of a printer driver;

measuring a resistance of a paper being printed;

comparing a paper property corresponding to the measured paper resistance with the selected paper property of the printer driver; and resetting the fixing condition according to the paper property corresponding to the measured paper resistance if the paper property corresponding to the measured paper resistance is different from the selected paper condition of the printer driver.

2. The method of claim 1, wherein the fixing condition is a fixing speed of the fixer.

3. The method of claim 1, wherein the step of comparing further comprises:

retrieving stored resistances associated with different types of paper from a look up table.

4. The method of claim 1, wherein the fixing condition comprises a temperature resetting.

5. The method of claim 1, wherein the resistance corresponds to various paper sizes and paper types.

6. The method of claim 1, wherein the resistance is measured with a paper resistance meter.

7. A printer comprising:

a print engine having a fixer capable of operating according to a set fixing condition;

a paper resistance meter for measuring a paper resistance;

a lookup table for storing the fixing condition corresponding to a paper property; and a controller for setting the fixing condition of the print engine by selecting the fixing condition from the lookup table according to the measured paper resistance.

8. The printer of claim 7, wherein the fixing condition comprises a fixing speed of the fixer.

9. The printer of claim 7, wherein the paper resistance meter measures the paper resistance when the paper passes between a transfer roller and a transfer belt that transfers an image onto the paper.

10. The printer of claim 7, wherein stored resistances associated with different types of paper are retrieved from the lookup table.

11. The printer of claim 7, wherein the fixing condition comprises a temperature resetting.

12. The printer of claim 7, wherein the resistance corresponds to various paper sizes and paper types.

13. The printer of claim 7, wherein the paper differs based on size and thickness.

* * * * *